US006770015B2

(12) United States Patent
Simonson

(10) Patent No.: US 6,770,015 B2
(45) Date of Patent: Aug. 3, 2004

(54) EXERCISE APPARATUS WITH SLIDING PULLEY

(75) Inventor: Roy Simonson, Colorado Springs, CO (US)

(73) Assignee: Free Motion Fitness, Inc., Colorado Springs, CO (US)

( * ) Notice: Subject to any disclaimer, the term of this patent is extended or adjusted under 35 U.S.C. 154(b) by 0 days.

(21) Appl. No.: 10/205,787

(22) Filed: Jul. 26, 2002

(65) Prior Publication Data

US 2004/0018920 A1 Jan. 29, 2004

(51) Int. Cl.[7] ..... A63B 21/062

(52) U.S. Cl. ..... 482/99; 482/101; 482/102; 482/103

(58) Field of Search ..... 482/92–94, 97–103, 482/106, 129, 130, 139

(56) References Cited

U.S. PATENT DOCUMENTS

| | | | | | |
|---|---|---|---|---|---|
| 480,271 | A | * | 8/1892 | Newton | 482/102 |
| 723,625 | A | * | 3/1903 | Thornley | 482/102 |
| 3,815,903 | A | * | 6/1974 | Blomqvist | 482/103 |
| 4,154,441 | A | | 5/1979 | Gajda | |
| 4,208,049 | A | * | 6/1980 | Wilson | 482/123 |
| 4,603,855 | A | * | 8/1986 | Sebelle | 482/103 |
| 4,632,388 | A | * | 12/1986 | Schleffendorf | 482/102 |
| 6,165,110 | A | * | 12/2000 | Gajda | 482/102 |
| 6,394,935 | B1 | * | 5/2002 | Lake | 482/94 |

FOREIGN PATENT DOCUMENTS

| | | | | |
|---|---|---|---|---|
| DE | 4241639 A1 | * | 6/1994 | A63B/21/018 |
| WO | WO 98/42411 | * | 10/1998 | |

OTHER PUBLICATIONS

"Selectorized Duals", HD 1900, *Hoist Fitness Systems*, Brochure, Copyright 2002, 1 pg.

"The New Dual Adjustable Pulley System", *Life Fitness*, Available, on information and belief, at least as early as Aug. 2000, 1 pg.

"Cable Column", *Free Motion*, Brochure, Available, on information and belief, at least as early as Feb., 2002, 1pg.

"Cable Crossover Club Series", *Life Fitness*, Internet page printed Oct. 7, 2002, 1 pg.

"H4600", *Hoist Fitness Systems*, Brochure, Copyright Sep. 2001, 2 pgs.

"The Ultimate Group Workout is Here", Advertisement, Available, on information and belief, at least as early as Feb., 2001, 1 pg.

"Coach Training and Certificate Program", *Group Free Motion*, Instructor Curriculum, Copyright 2001, 88 pgs.

"Free Motion Group Training Manual", *Free Motion Fitness, Inc.*, Copyright 2001, 50 pgs.

"Free Motion Facility Manual", *Free Motion Fitness, Inc.*, Copyright 2001, 43 pgs.

* cited by examiner

*Primary Examiner*—Nicholas D. Lucchesi
*Assistant Examiner*—Victor Hwang
(74) *Attorney, Agent, or Firm*—Workman Nydegger

(57) ABSTRACT

The present invention is directed to an exercise apparatus that includes a frame housing a weight stack. A sliding assembly is coupled to the frame and weight stack. The sliding assembly includes, but is not limited to, a guide column, a sliding element disposed on the guide column, a pulley attached to the sliding element, a first mount disposed at one end of the guide column, a second mount coupled to the sliding element, and a first cable disposed in the pulley. The first cable has a first end attached to one end of the guide column, an intermediate portion disposed in the pulley, and a second end terminating in a handle. A second cable may have a first end attached to the sliding element or the first mount and a second end attached to the weight stack. In one embodiment, the guide column, first mount, and second mount are rotatable independently of each other.

42 Claims, 9 Drawing Sheets

EXERCISE APPARATUS WITH SLIDING PULLEY

BACKGROUND OF THE INVENTION

1. The Field of the Invention

This invention relates to exercise equipment. More particularly, this invention relates to exercise equipment wherein the angle of application of force continuously changes during utilization of the exercise device.

2. The Relevant Technology

Various types of exercise apparatus are known wherein a pulley and weight are combined for limited range muscle development. In these exercise devices, a cable is led through a pulley or series of pulleys and is attached to a weight. The free end of the cable usually terminates in a handle or is coupled to a handle. The angle of pull of the handle is sometimes adjustable, but once adjusted, the angle of pull is typically constant. A person using such devices for exercise must change the angle of the body to work a muscle from a different angle so as to compensate for the limit/range ratio. It would, however, be desirable to provide an exercise device which can be used for full range muscle development without requiring such body movement. Furthermore, it would be desirable to provide an exercise device wherein a wide range of muscles are developed by utilization of the exercise device.

SUMMARY AND OBJECTS OF THE INVENTION

An object of the present invention is to provide a pulley and weight type exercise device wherein the angle of pull is continuously varied as the exercise device is utilized.

It is another object of the present invention to provide an exercise device for more specific full range muscle development, particularly of an antagonist group.

It is yet another object of the present invention to provide a sliding assembly which may be implemented in a variety of exercise devices.

It is another object of the present invention to provide a sliding assembly which may be used to strengthen various muscles in the human body.

In summary, the present invention provides an exercise apparatus that includes a frame housing a weight stack. A sliding assembly is coupled to the frame and weight stack. The sliding assembly includes, but is not limited to, a guide column, a sliding element disposed on the guide column, and a pulley attached to the sliding element. The sliding assembly also includes a first cable having a first end attached to one end of the guide column, an intermediate portion disposed in the pulley, and a second end terminating in a handle. The sliding assembly may also include a first mount disposed at one end of the guide column, wherein the first end of the first cable is attached to the first mount.

A second cable may have a first end attached to the sliding element and a second end attached to the weight stack. The sliding assembly may also include a second mount disposed at and coupled to one end of the sliding element, wherein the first end of the second cable is attached to the second mount.

In one embodiment, the guide column is rotatable about a longitudinal axis of the guide column. The guide column and first and second mounts may be rotatable independently of each other.

In one embodiment, the sliding assembly is coupled to a wheel assembly, the wheel assembly being coupled to the frame. The wheel assembly allows the sliding assembly to be rotatably positioned substantially 360° about an axis transverse to the guide column. In another embodiment, two sets of pulley assemblies are mounted to a lower portion of the frame to form an exercise device which is useful for arm curl-type exercises. In yet another embodiment, two sets of pulley assemblies are mounted to an upper portion of a frame to form an exercise device which is useful for pull-down-type exercises. It will be appreciated that the sliding assembly described in following description is applicable in a variety of exercise devices.

These and other features of the present invention will become more fully apparent from the following description and appended claims, or may be learned by the practice of the invention as set forth hereinafter.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
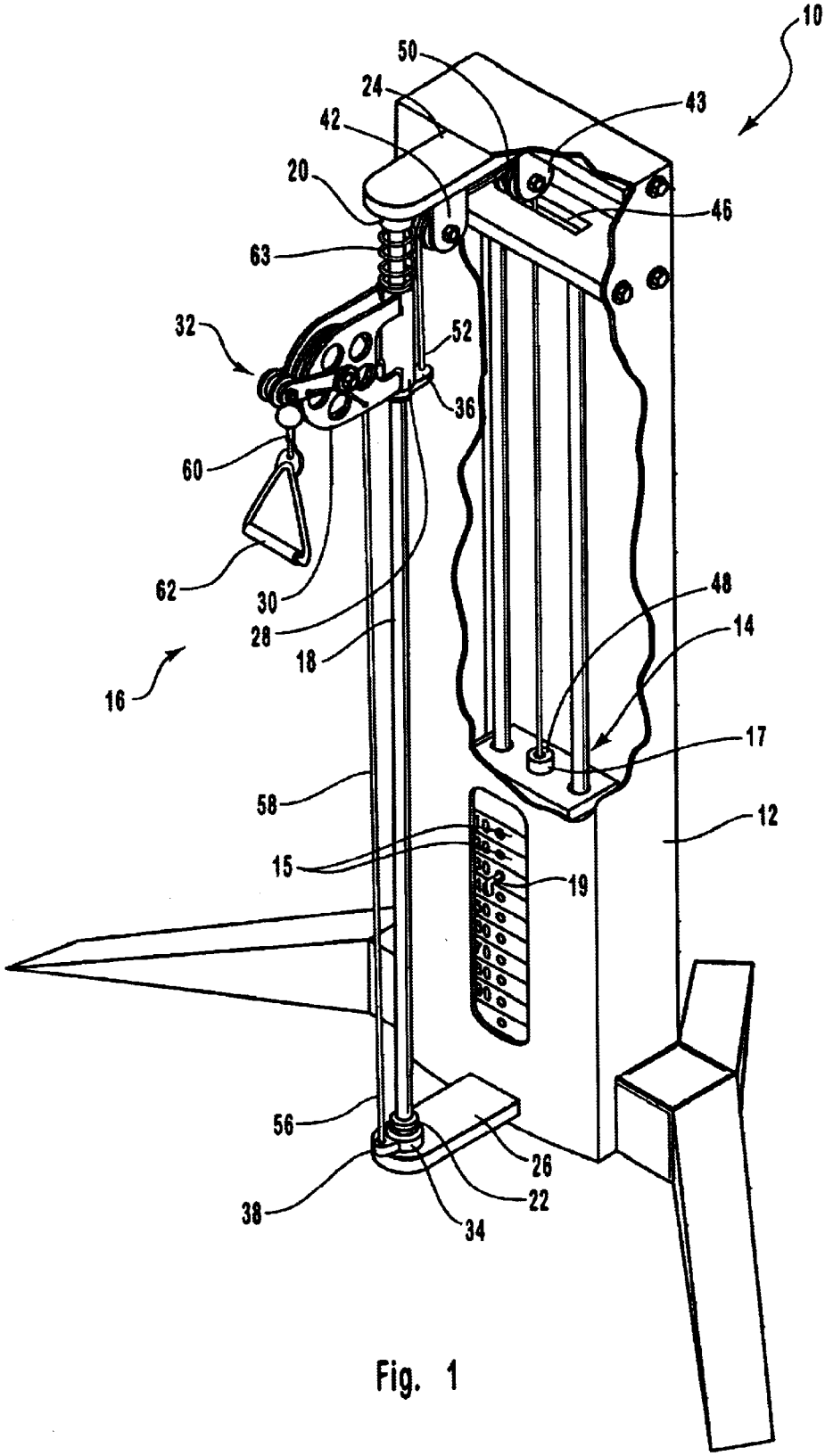
FIG. 1 illustrates a perspective view of an exercise apparatus of the present invention.

The present invention is directed to an exercise machine which provides a continuous range of pull in order to develop complete muscle strength. In accordance with the present invention, an exercise apparatus 10 is shown in FIG. 1. As depicted in FIG. 1, exercise apparatus 10 has a frame 12 housing a weight stack 14. Weight stack 14 is a selective weight stack. In the embodiment of FIG. 1, weight stack 14 comprises a plurality of weights 15 stacked on top of each other with a perforated selector rod 17 disposed longitudinally through the center of weights 15. The exerciser can select the amount of weight desired by placing a pin 19 within particular weights 15 and in a desired bore within rod 17. The top end of rod 17 is coupled to other moving parts of the exercise apparatus 10 as will be discussed in more detail below.

In the embodiment shown in FIG. 1, a sliding assembly 16 is coupled to weight stack 14 and mounted on frame 12.

Sliding assembly 16 generally includes, but is not limited to, a guide column 18, a sliding element 28, a pulley 30, firsthand second mounts 34, 36, and cable 54. Guide column 18 has a first end 20 and a second end 22. First end 20 of guide column is mounted to frame 12 by bracket 24. First mount 34 is disposed around second end 22 of guide column 18. Second end 22 of guide column 18 passes through first mount 34 and is mounted to frame 12 by bracket 26. Brackets 24, 26 may position sliding assembly 16 in an infinite range of angles in relation to frame 12.

Guide column 18 is a generally cylindrical, elongate rod. In one embodiment, guide column 18 is a case-hardened linear bearing shaft. Sliding element 28 is slidably disposed on guide column 18 such that sliding element 28 can be selectively positioned along the length of guide column 18. Pulley 30 is attached to sliding element 28.

Sliding element 28 may be a sleeve, collar, or a similar structure which completely encircles guide column 18. However, a sliding element of the present invention may be a structure which does not completely encircle guide column 18, but which still allows the sliding element to be selectively positioned along the length of guide column 18.

Guide column 18 and sliding element 28 are shown in FIG. 1 as substantially cylindrically shaped structures. It will be appreciated that a guide column and sliding element of the present invention may have a cross-section constructed from a variety of shapes such as, but not limited to square, rectangular, oblong, triangular, and the like, so long as the sliding element is able to be selectively positioned along the guide column. Furthermore, it will be appreciated that a guide column of the present invention may be linear, arced, or otherwise curved, depending on the use of exercise apparatus 10.

As depicted in FIG. 1, a first mount 34 is movable coupled with guide column 18 at second end 22 of guide column 18. Alternatively, first mount 34 may be movably coupled with guide column 18 at first end 20 of guide column 18. A second mount 36 is movably coupled with one end of sliding element 28. As shown more clearly in FIGS. 3A and 4, mounts 34, 36 have a finger 38, 40, respectively, projecting radially there from. Mounts 34, 36 will be discussed below in further detail.

A first cable and pulley system 32 is formed by pulley 30 and cable 54. Cable 54 has a first end 56 attached to finger 38 of first mount 34, an intermediate portion 58 disposed on pulley 30, and a second end 60 terminating in a handle 62. Cable and pulley system 32 will be discussed below in further detail.

System 32 is an example of an actuation assembly that is configured to enable the user to selectively position the sliding element. The actuation assembly 32 is actuated when the cable is pulled. Other examples of actuation assemblies may comprise, for example, a cable and/or handle coupled to the sliding element. Thus, a cable, a handle, or a cable having a handle coupled thereto are additional examples of an actuation assembly.

Sliding assembly 16 is coupled to a resistance assembly. The resistance assembly provides a resistance force to sliding element 28 as it is selectively positioned along guide column 18. In particular, the resistance assembly restores sliding element 28 back to its original starting position so that the exerciser may perform a series of repetitious movements on exercise apparatus 10. The resistance assembly comprises a second cable and pulley system and weight stack 14. The second cable and pulley system comprises a second pulley 42 shown mounted on bracket 24. Second pulley 42 assists in coupling weight stack 14 to sliding assembly 16. The second cable and pulley system may also comprise a third pulley 43 is mounted to frame 12 so as to be disposed above weight stack 14. Third pulley 43 also assists in coupling weight stack 14 to sliding assembly 16. It will be appreciated that pulley 42 could also be mounted on guide column 18 or frame 12. Further, the second cable and pulley system may comprise any number of pulleys in order to increase or decrease resistance accordingly.

The second cable and pulley system comprises a cable 46 which connects weight stack 14 to sliding assembly 16. Cable 46 has a first end 48 attached to weight stack 14, an intermediate portion 50 disposed on pulleys 42, 43, and a second end 52 attached to finger 40 of second mount 36.

It will be appreciated that second end 52 of cable 46 and first end 56 of cable 54 may be securely attached to any part of mounts 34, 36 and that fingers 38, 40 are not required. Further, cables of the present invention may comprise a variety of structures including, but not limited to, a cord, chain, a line, a string, a wire, a rope, or the like. In addition, cables of the present invention may be made out of any suitable material (e.g., metal, plastic, rope, and the like) which will provide sufficient strength to allow a user to operate exercise apparatus 10.

A spring 63 may be disposed between bracket 24 and sliding element 28 at first end 20 of guide column 18. Spring 63 provides cushion as sliding element 28 is selectively positioned along guide column 18. In the embodiment of FIG. 1, spring 63 is fixedly attached to first end 20 of guide column 18. In an alternative embodiment, spring 63 comprises a rubber bumper disposed at first end 20 of guide column 18 to cushion the sliding element as it returns to a resting position.

Figure 2:
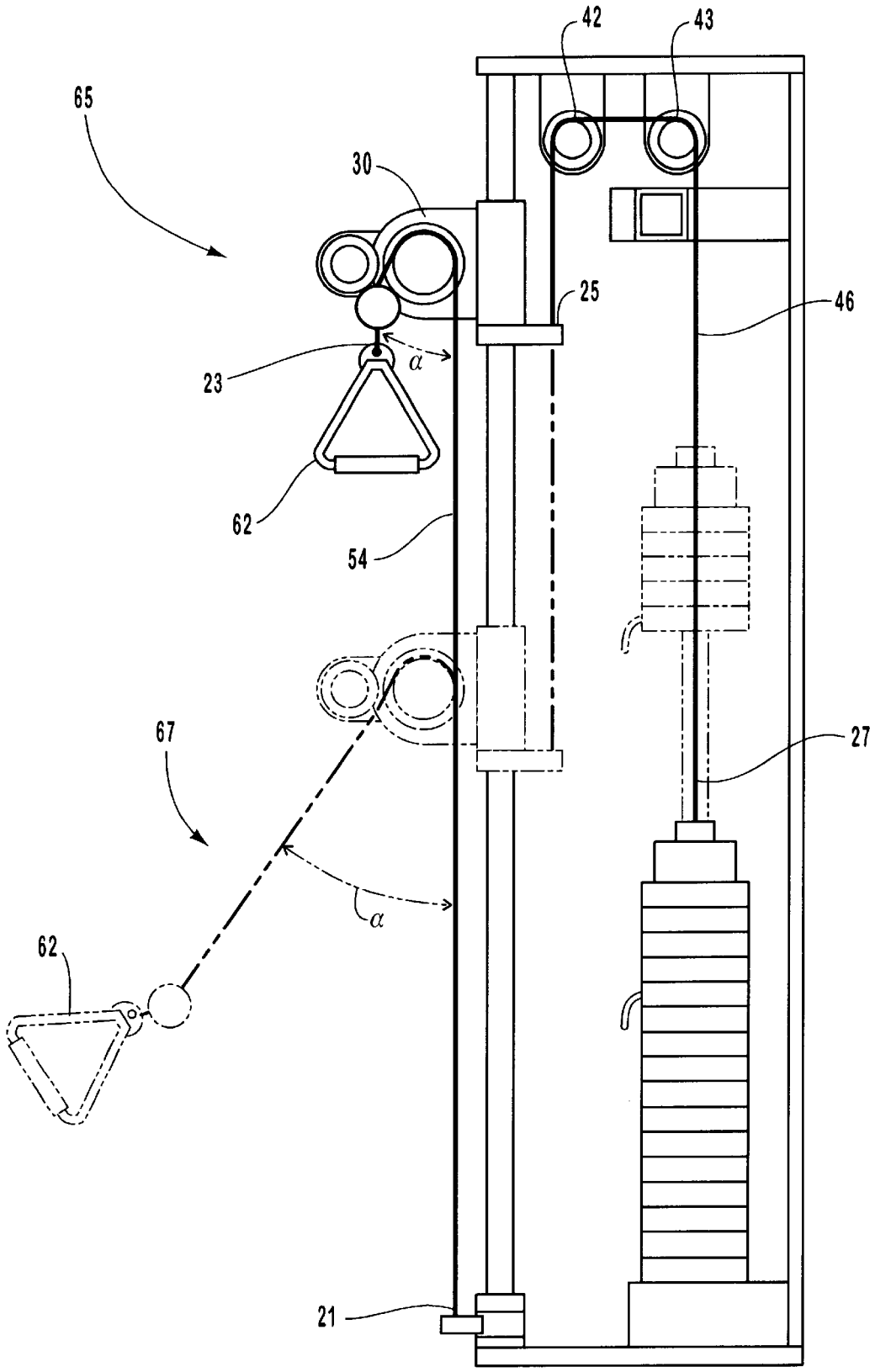
FIG. 2 illustrates a schematic pulley diagram as contemplated in the exercise apparatus of FIG. 1.

FIG. 2 shows a schematic drawing of an embodiment of the present invention. As shown therein, pulley 30 is operated by cable 54 between a fixed point 21 and a movable point 23. For example, in exercise device 10 shown in FIG. 1, fixed point 21 is second end 22 of guide column 18 and movable point 23 is handle 62. Pulley 30 is also coupled to cable 46. Cable 46 is connected between a movable point 25 and a movable point 27. In FIG. 1, movable point 25 is second mount 36 and movable point 27 is weight stack 14.

Handle 62 is operable by an exerciser to selectively operate sliding assembly 16 between a resting position 65 and an actuated position 67. As shown in FIG. 2, resting position 65 is shown in solid lines. Resting position 65 is defined as the state of sliding assembly 16 when no force is applied. In contrast, actuated position 67 is any position of sliding assembly 16 in which force is applied. Actuated position 67 is shown in FIG. 2 in phantom lines. When the exerciser pulls handle 62, the force acts on pulley 30 which causes sliding element 28 to slide along guide column 18. Because pulleys 30, 42, 43 are coupled through cable 46, the movement of pulley 30 also produces movement in pulleys 42, 43. This movement is only impeded by the gravitational weight of weight stack 14. As force is released from cable 54, weight stack 14 acts as a counterweight producing a reverse movement in pulleys 30, 42, 43 such that sliding assembly 16 returns to its original resting position. As sliding element 28 slides along guide column 18, the angle of pull a increases or decreases accordingly. Such sliding action results in a continuous range of pull for the exerciser.

Figure 3A:
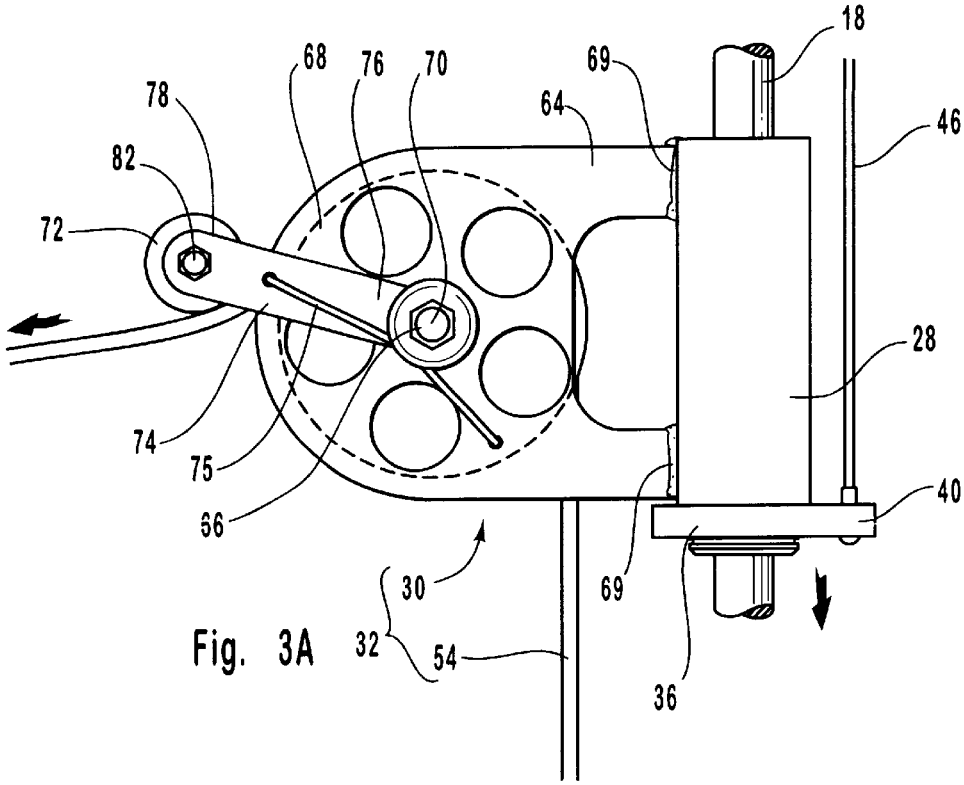
FIG. 3A illustrates a fragmentary view of a part of the sliding assembly of the exercise apparatus of FIG. 1.

Turning now to FIG. 3A, depicted therein is a fragmentary view of a portion of sliding assembly 16 in more detail. Pulley 30 and cable 54 form first cable and pulley system 32. As shown in FIG. 3A, pulley 30 comprises a housing 64 having a pivot point 66 and a wheel 68. Wheel 68 may be rotatably attached to housing 64 by a pin 70 disposed in pivot point 66. Wheel 68 has a channel (not shown) disposed therein for receiving cable 54. In the embodiment of FIG. 3A, housing 64 is mechanically attached to sliding element 28, for example, by welding. As shown in FIG. 3A, housing 64 is attached to sliding element 28 at welding points 69. In another embodiment, housing 64 may be integrally formed with sliding element 28. It will be appreciated that housing 64 may be attached to sliding element 28 by other means such as, but not limited to, injection molding, adhesive, mechanical hinges, and the like.

A secondary wheel 72 is shown aligned with wheel 68. Secondary wheel 72 prevents second end 60 (not shown) of cable 54 with its handle 62 (not shown) from becoming disengaged with pulley 30 and keeps handle 62 in a convenient place for the exerciser to grasp. Secondary wheel 72 is mounted on housing 64 by an arm 74. First end 76 of arm 74 is fixedly attached to housing 64 at pivot point 66. First end 76 of arm 74 may be attached by welding, adhesive, and the like. Second end 78 of arm 74 comprises a bore (not shown) through which a pin 82 is disposed to rotatably mount secondary wheel 72. Secondary wheel 72 may also have a channel (not shown) configured to receive cable 54. A torsion spring 75 has one end disposed through a portion of arm 74, an intermediate portion wrapped around pin 70 and another end disposed through housing 64. In one embodiment, spring 75 allows for movement of arm 74 about housing 64 within a range of about 90 to about 120 degrees.

Figure 3B:
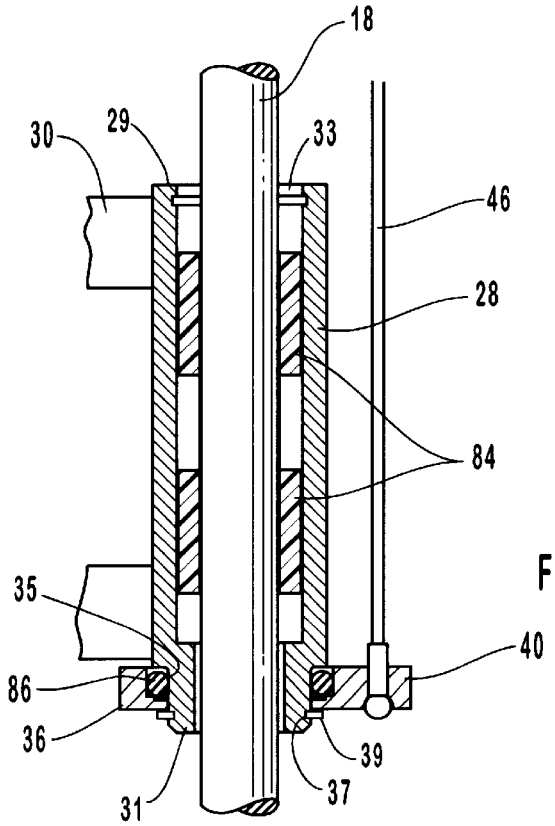
FIG. 3B illustrates a cross-sectional view of the fragmentary view of FIG. 3A.

Shown in FIG. 3B is a cross-section of guide column 18 which shows in more detail one embodiment in which sliding element 28 and second mount 36 are movably coupled. Sliding element 28 comprises a first end 29 and a second end 31. Sliding element 28 is preferably hollow so as to allow guiding column 18 to pass there through. A cap 33 may cover the opening of first end 29 of sliding element 28. At second end 31 of sliding element 28, an inwardly formed shoulder 35 is formed around the periphery of sliding element 28. Second mount 36 is disposed over shoulder 35 of sliding element 28. A recess 37 is formed at second end 31 of sliding element 28. After second mount 36 is placed on sliding element 28, a retainer clip 39 is placed in recess 37 to retain second mount 36 on sliding element 28. A nylon spacer (not shown) may be disposed between second mount 36 and retained clip 39 to prevent the two objects from rubbing together.

It will be appreciated that sliding element 28 and second mount 36 may be movably coupled in a variety of different ways. As described above, second mount 36 may be disposed entirely on sliding element 28 without any part of second mount 36 being in contact with guide column 18. In another embodiment, second mount 36 could be movably coupled to sliding element 28 such that most of second mount 36 is disposed about guide column 18 instead of sliding element 28. It will be appreciated that a claim limitation directed toward second mount 36 being movably coupled to guide column 18 covers both embodiments.

In the embodiment of FIG. 3B, sliding element 28 comprises one or more bearings 84. Bearings 84 allow for smooth, linear movement of sliding element 28 along guide column 18 but substantially prevents rotational movement of sliding element 28. Sliding elements of the present invention may comprise linear or recirculating bearings (e.g., nylon bearings). Alternatively, sliding elements may have bearings which allow both linear and rotational movement of sliding element 28 about guide column 18. Thus, when sliding element 28 is selectively moved along guide column 18, the exerciser experiences a substantially frictionless glide of the sliding element, effected only by the resistance of weight stack 14. Similarly, because sliding element 28 glides easily along guide column 18, sliding element 28 is able to move easily back to its resting position by the force of cable 46 connected to second mount 36.

In the embodiment of FIG. 3B, second mount 36 comprises bearings 86. Bearings 86 allow rotational movement of second mount 36 about sliding element 28. In another embodiment where second mount 36 is in contact with guide column 18 and coupled to sliding element 28, second mount 36 may comprise both linear and rotational bearings 86. Alternatively, bearings 86 of the present invention may allow only linear movement of second mount 36 about guide column 18, but not rotational movement. Having linear and/or rotational bearings on sliding element 28 and/or second mount 36 provides a smooth, frictionless motion as the exerciser operates exercise device 10.

Given that both sliding element 28 and second mount 36 can have linear and/or rotational bearing, it will be appreciated that many combinations of bearings may be possible depending on the uses of the exercise apparatus 10. For example, sliding element 28 may have linear bearings 84 and second mount 36 have linear and rotational bearings 86. In this embodiment, sliding element 28 and second mount 36 can slide linearly along guide column 18 while second mount 36 can rotate independent of sliding element 28. In another example, both sliding element 28 and second mount 36 have linear and rotational bearings 84, 86. This allows both sliding element 28 and second mount 36 to move linearly and radially about guide column 18. In yet another example, sliding element 28 and second mount 36 may have linear bearings 84, 86 but be fixedly connected together so that they move as a unit. In another embodiment, both sliding element 28 and second mount 36 have rotational bearings 84, 86 but are fixedly attached so that they move as a unit. Other embodiments will be apparent from the foregoing examples.

Figure 4:
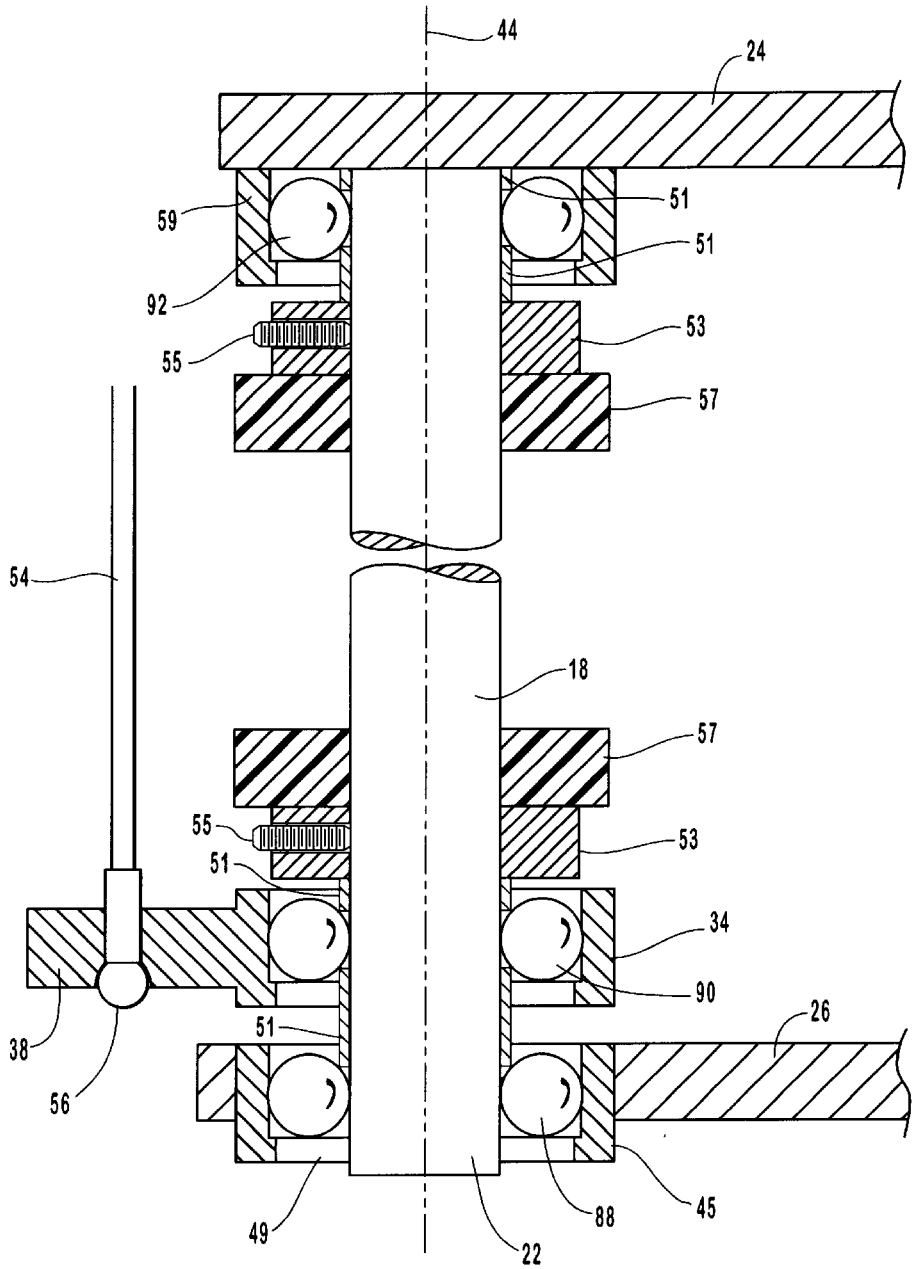
FIG. 4 illustrates a cross-sectional view of a fragmentary view of part of the sliding assembly of the exercise apparatus of FIG. 1.

As shown in FIG. 4, first end 20 and second end 22 of guide column 18 are shown in further detail. As shown in FIG. 4, first end 20 of guide column 18 is coupled to first bracket 24. Bracket 24 comprises a bearing tube 59 welded therein. Bearing tube 59 has bearings 92 disposed therein. A collar 53 is disposed about guide column 18 below bearing tube 59. Collar 53 is fixed about guide column 18 by a set of screws 55 disposed through the peripheral edge of collar 53 and extending into guide column 18. Collar 53 rides on top of bearings 92. As will be appreciated, guide column 18 is thus held in place in bracket 26 by collar 53. Guide column 18 is thus able to rotate independently of bracket 24. A bumper 57 is disposed below collar 53. Bumper 57 does not have to be fixed to guide column 18 and provides a resting surface for sliding element 28 as it is moves toward first end 20 of guide column 18. A spacer 51 is provided to divide bearings 92 from bracket 24. Another spacer 51 is provided to separate collar 53 from bearing tube 59.

First end 20 of guide column 18 is disposed in bearing tube 59 such that guide column 18 is allowed to rotate therein. Alternatively, guide column 18 may be fixedly attached to bracket 24. In another embodiment, bearing tube 59 is formed integrally with first bracket 24 such that the bracket provides the function of the bearing tube. That is, an opening may be formed in bracket 24 to receiving guide column 18 and a set of bearings. A cap may be placed on the opening to prevent the bearings from falling out.

Second end 22 of guide column 18 is mounted on second bracket 26. As shown in FIG. 4, a bearing tube 45 is disposed in bracket 26. Bearing tube 45 may be welded or otherwise attached to bracket 26. Guide column 18 is disposed in bearing tube 45. Bearing tube 45 has bearings 88 therein. Bearing tube 45 may also comprise a cap on or adjacent to rim 49 to cover bearings 88. First mount 34 is rotatably coupled to guide column 18 above bearing tube 45. In one embodiment, first mount 34 is disposed about guide column 18, as shown in FIG. 4. In another embodiment, first mount 34 may be disposed about guide column and rotatably engaged with second bracket 26. First mount 34 has bearings 90 therein which allow first mount 34 to rotate in relation to guide column 18. In one embodiment, bearing tube 45 is formed integrally with second bracket 26 such that the bracket provides the function of the bearing tube. That is, an opening may be formed in bracket 26 to receiving guide column 18 and a set of bearings.

A collar 53 is disposed about guide column 18 above first mount 34. Collar 53 is fixed about guide column 18 by a set of screws 55 disposed through the peripheral edge of collar 53 and extending into guide column 18. Collar 53 rides on top of bearings 90. As will be appreciated, guide column 18 is thus held in place in bracket 26 by collar 53. Guide column 18 is thus able to rotate independently of bracket 26 and first mount 34. Likewise, first mount 34 is able to rotate independently of bracket 26 and guide column 18. A bumper 57 is disposed above collar 53. Bumper 57 does not have to be fixed to guide column 18 and provides a resting surface for sliding element 28 as it is moved toward second end 22 of guide column 18. A spacer 51 is provided to divide first mount 34 from bearing tube 45. Another spacer 51 is provided to divide first mount 34 from collar 53.

The foregoing describes an embodiment wherein guide column 18 and mounts 34, 36 are rotatable about a longitudinal axis 44 extending through the guide column. That is, guide column 18 can rotate about longitudinal axis 44 in either direction while mounts 34, 36 can rotate independently of guide column 18. In this embodiment, guide column 18 and first mount 34 rotate independently of each other. When a rotational force is applied to pulley 30, linear bearings 84 substantially prevent sliding element 28 from rotating. Instead, the rotational force is translated to guide column 18 which rotates due to bearings 88. Furthermore, mounts 34, 36 are allowed to rotate independently of guide column 18. Thus, when guide column 18 experiences a rotational force, such rotational force is not translated to mounts 34, 36. Thus, mounts 34, 36 are able to remain substantially aligned with cables 46, 54. Advantageously, the foregoing allows exercisers to experience a continuous, frictionless motion which adjusts according to rotational forces.

In another embodiment, guide column 18 may be rotatably mounted to brackets 24, 26 having first mount 34 coupled thereto (e.g., by bolting, welding, etc.) so that they rotate simultaneously. In still another embodiment, guide column 18 may be rotatably mounted to brackets 24, 26 while first mount 34 is fixedly attached to second bracket 26.

In yet another embodiment, guide column 18 may be mounted on brackets 24, 26 such that the guide column is fixedly attached. In this fixed embodiment, first and second mounts 34, 36 may still be able to rotate around guide column 18. In the embodiment where guide column 18 is fixedly attached to brackets 24, 26, sliding element 28 comprises linear and rotational bearings 84, and mounts 34, 36 have rotational bearings. In this embodiment, a rotational force applied to pulley 30 would cause sliding element 28 to rotate about guide column 18. However, mounts 34, 36 are independently rotatable from sliding element 28 and guide column 18. Thus, any movement of cable 46 or 54 would be translated to mounts 34, 36 which would rotate such that they align with cables 46, 54. Again, the exerciser is able to use exercise apparatus 10 from a variety of positions and angles while still having a continuous, frictionless exercise motion.

Thus, the exerciser can operate the exercise apparatus 10 from a variety of angles about guide column 18. For example, the exerciser may use exercise apparatus 10 to do arm curls, side-to-side exercises, arm pulls, and the like. Thus, bearings 84, 86, 88, 90, 92 provide a smooth, low impact motion as sliding element 28 is selectively positioned along guide column 18. Furthermore, the bearings prevent undue stress from being applied to cables 46, 54 when sliding assembly 16 is operated.

It will be appreciated that sliding element 28 may operate without first mount 34. Cable 46 would thus be directly connected to sliding element 28. In addition, second mount 36 may also be removed and, in the place thereof, first end 56 of second cable 54 is mounted to second bracket 26 or another fixed structure. In either embodiment, sliding element 28 may still have rotational and/or linear bearings 84 to provide a continuous, frictionless motion.

The sliding assembly 16 of the present invention may be implemented in a variety of different ways to provide exercise apparatuses directed toward different uses. In the embodiments shown in FIGS. 5 and 6, a sliding assembly 16 is implemented in exercise apparatus 100. Because exercise apparatus 100 is similar to the embodiment described above for exercise apparatus 10, like elements will be referred to with like reference characters. Exercise apparatus 100 comprises a wheel assembly 104 and a support member 106 mounted thereon. Wheel assembly 104 preferably has an aperture 105 to receive cable 46 there through. Support member 106 has a first end 108 and a second end 110. Sliding assembly 16 is mounted to support member 106 by first and second brackets 24, 26, which are attached to first end 20 and second end 22, respectively, of guide column 18. Support member 106 may be mechanically coupled to wheel assembly 104 by a variety of means such as, but not limited to, welding, adhesive, bolting, and the like.

Wheel assembly 104 allows sliding assembly 16 to be rotated substantially 360° about an axis formed transversely to guide column 18. In the embodiment shown in FIG. 5, a bumper 102 is placed around the periphery of wheel assembly 104. A corresponding stop 103 is disposed transversely through support member 106 so that it aligns with bumper 102. Thus, when stop 103 comes into contact with bumper 102, wheel assembly 104 is prevented from rotating. A bumper/stop assembly may be advantageous where it is desired to prevent the cable in pulley assembly 16 from becoming too tightly wound. A counterweight 107 may be disposed in second end 110 of support member 106 to offset the weight of pulley assembly 16.

Figure 5:
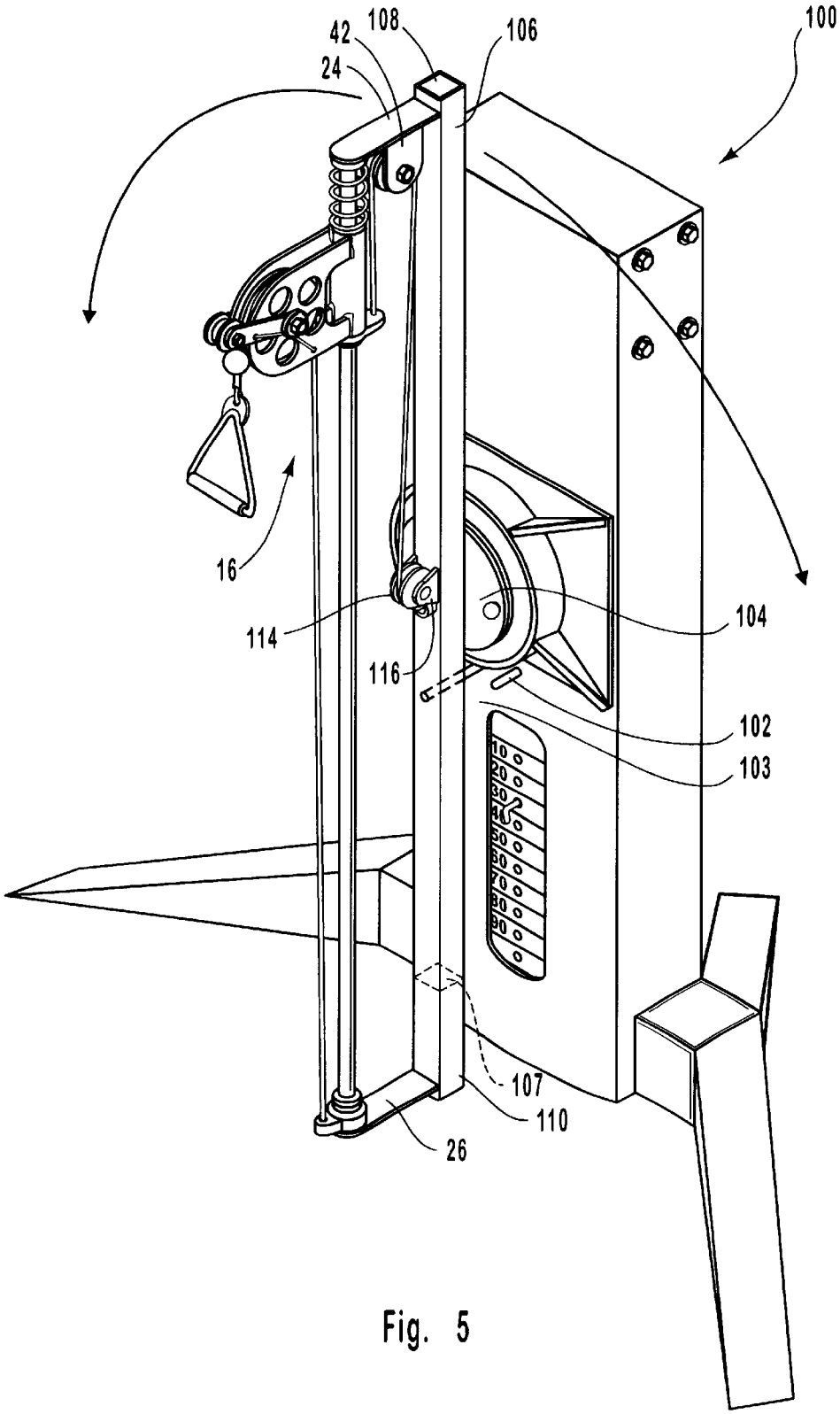
FIG. 5 illustrates a perspective view of another embodiment of the present invention.
Figure 6:
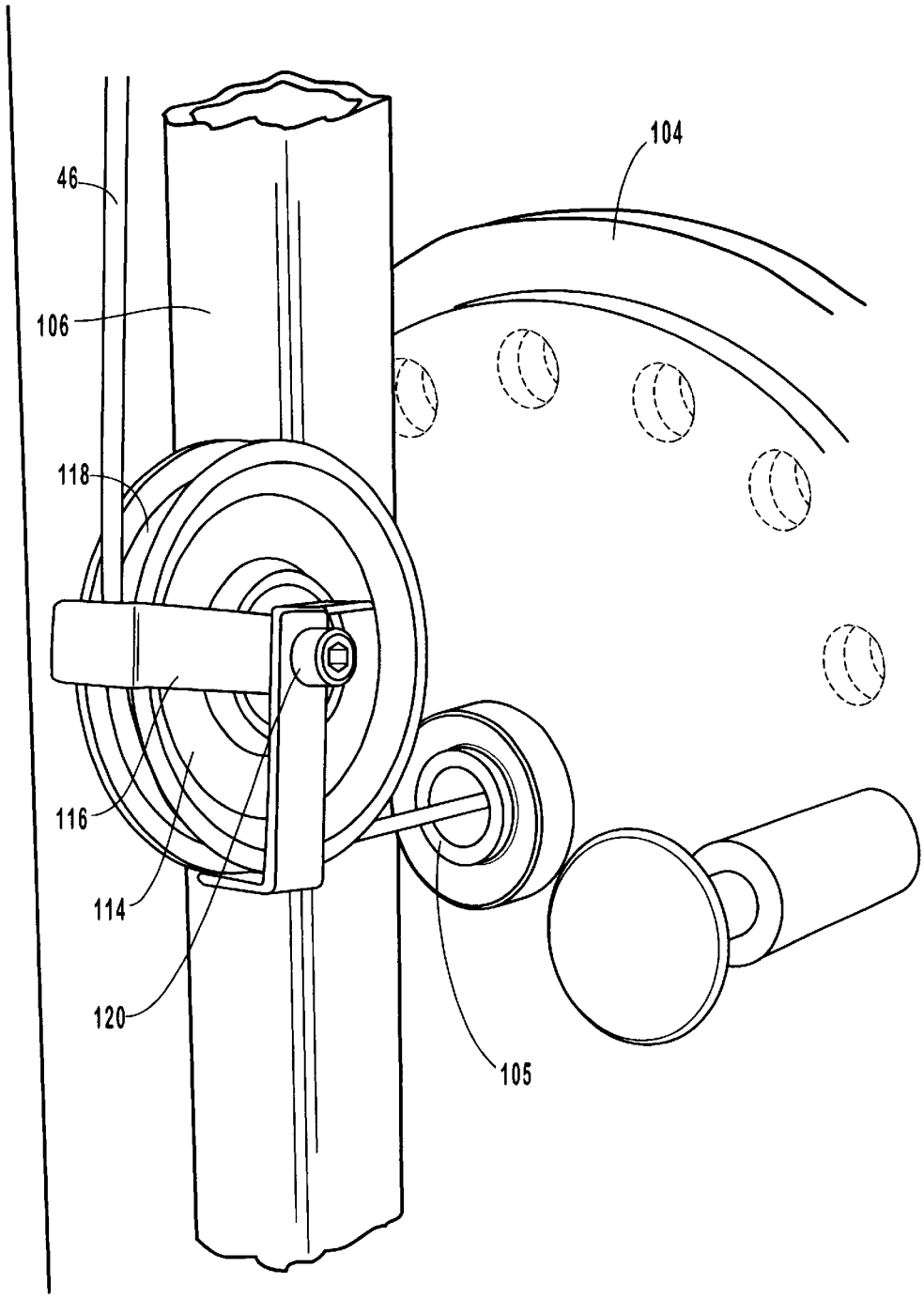
FIG. 6 illustrates a fragmentary view of the wheel assembly of the exercise apparatus of FIG. 5.

Exercise apparatus 100 has a pulley 114 mounted to support member 106 by a bracket 116. As shown in more detail in FIG. 6, pulley 114 comprises a wheel 118 rotatably disposed on bracket 116 at pivot point 120. Wheel 118 may have a channel (not shown) to receive cable 46. Preferably, the channel of wheel 118 is aligned with aperture 105 so that cable 46 exiting aperture 105 does not slack between wheel assembly 104 and pulley 114. In the embodiment of FIG. 5, support member 106 is aligned with aperture 105. In contrast, in the embodiment of FIG. 6, support member 106 is offset from aperture 105 but pulley 114 is aligned with aperture 105. Thus, a first cable 46 has a first end 48 coupled to weight stack 14, an intermediate portion 50 disposed through pulley 114, another intermediate portion 50 disposed through pulley 42 and a second end 52 coupled to second mount 36.

Figure 7A:
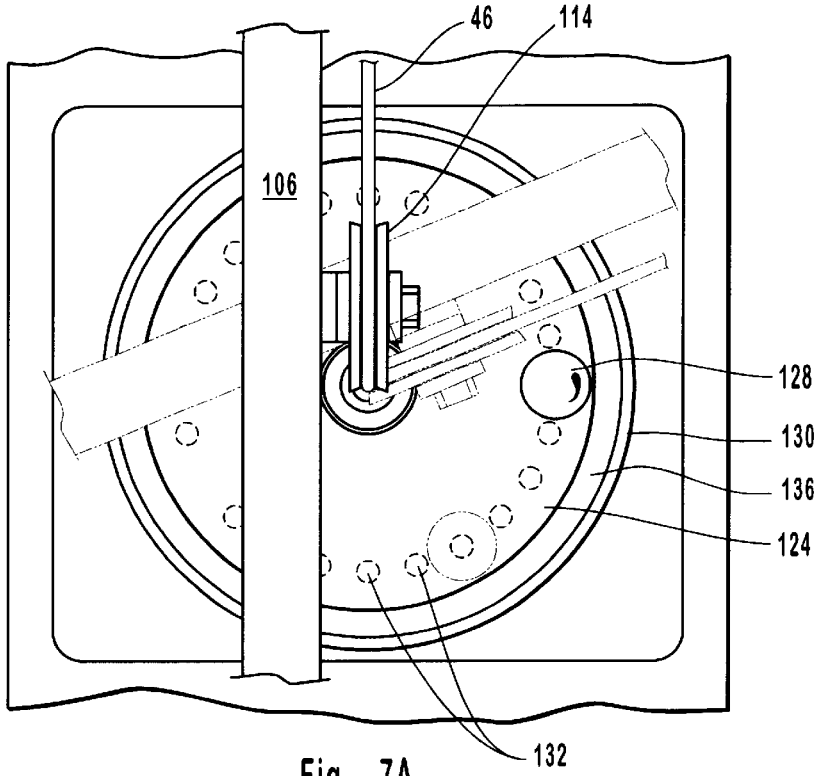
FIG. 7A illustrates a front fragmentary view of the wheel assembly of the exercise apparatus of FIG. 5.
Figure 7B:
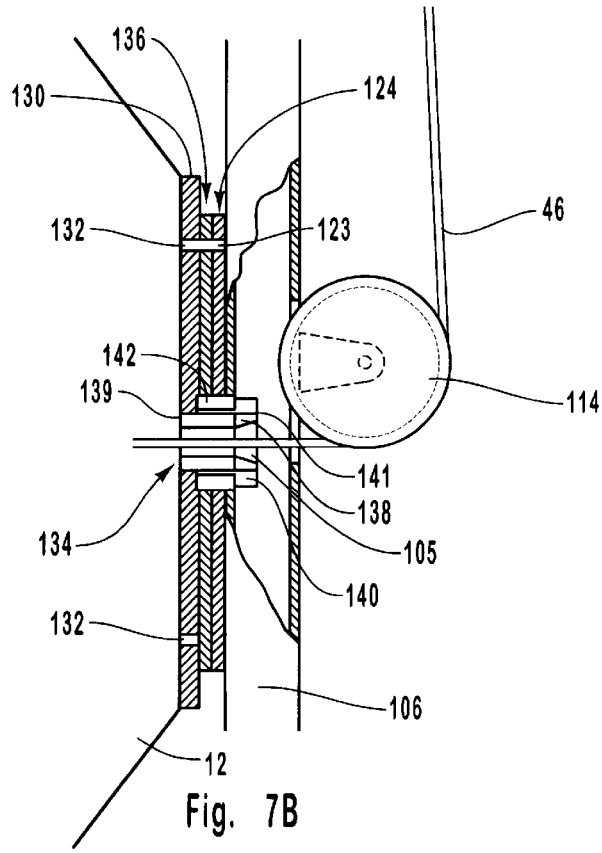
FIG. 7B illustrates a side view of the wheel assembly of the exercise apparatus of FIG. 5.

Referring now to FIGS. 7A and 7B, wheel assembly 104 is described in further detail. As shown in FIG. 7A, wheel assembly 104 comprises an outer disc 124, an inner disc 130, and a nylon washer 136 disposed therebetween. Outer disc 124 is disposed substantially concentrically with inner disc 130. Inner disc 130 is fixedly attached to frame 12. Outer disc 124 and inner disc 130 are rotatably coupled by a locking assembly 134 such that outer disc 124 can rotate in relation to inner disc 130. Locking assembly 134 comprises a shaft 138 having a first end 139 attached to frame 12 and/or inner disc 130 and having a second end 141 extending through outer disc 124. Preferably, second end 141 of shaft 138 is heavily chamfered on the inner surface so that cable 46 does not chafe. A collar 140 is disposed about second end 141 of shaft 138. Collar 140 may be tightened about shaft 138 by a set of screws (not shown). Alternatively, collar 140 may be threadedly or otherwise attached to shaft 138. A bushing 142 may be disposed between shaft 138 and outer disc 124 and washer 136.

Outer disc 124 comprises an aperture 123 having a pin (not shown) disposed therein. The pin terminates in a handle 128 which is accessible to the exerciser. Aperture 123 may also have a spring 125 disposed therein to bias the pin inward. Inner disc 130 comprises a plurality of ports 132 which are located about every 10°–15° around inner disc 130. It will be appreciated that ports 132 may be vary in their spacing depending on the particular exercise device. Aperture 123 of outer disc 124 can be aligned with any of ports 132. Thus, the exerciser can selectively insert the pin into one of ports 132, determining the position of outer disc 124 in relation to inner disc 130. It will be appreciated that by so doing, the exerciser is correspondingly selecting the angle of rotation of support member 106 which is welded or otherwise attached to outer disc 124 of wheel assembly 104. As shown in FIG. 7A, support member 106 is shown in a vertical position in solid lines. Alternatively, the exerciser can position support member 106 in another angle as shown in phantom lines using wheel assembly 104.

As shown in FIG. 5, sliding assembly 16 can be positioned vertically with pulley 30 being disposed above the exerciser so that the exerciser may perform exercises such as arm curls, arm pulls, and the like. The exerciser may selectively position guide column 18 substantially 360° to maximize the particular exercise that the exerciser wishes to perform. For example, as previously discussed, when guide column 18 is vertically positioned with sliding assembly 16 disposed above the exerciser, the exerciser can do various pull-down exercises. When rotated about 20°–40°, from a vertical axis, the sliding assembly 16 is ideally aligned to perform golf-swing exercises. When rotated 90°, from a vertical axis, the sliding assembly 16 is situated to perform side-to-side exercises. When rotated to 180°, from a vertical axis, the sliding assembly 16 is disposed so that the exerciser can perform various pull-up exercises. The exerciser can then rotate guide column 18 throughout another 180° to perform exercises on the opposite side. In addition, various accessories may be added to handle 62 to enable the exerciser to more closely simulate a particular exercise. For example, a golf handle may be attached to handle 62 to more closely simulate golf swing exercises.

Thus, it will be appreciated that guide column 18 can potentially rotate about two axes. The first axis is described above with reference to FIGS. 1 and 4 in which bearings 88 allow guide column 18 to rotate about a longitudinal axis 44 disposed through guide column 18. The second axis is formed transversely to aperture 105 of wheel assembly 104 or transversely to guide column 18 as described above with reference to FIG. 6. Sliding assembly 16 is, thus, versatile, and useful in various applications, some examples of which are discussed below in further detail.

Figure 8:
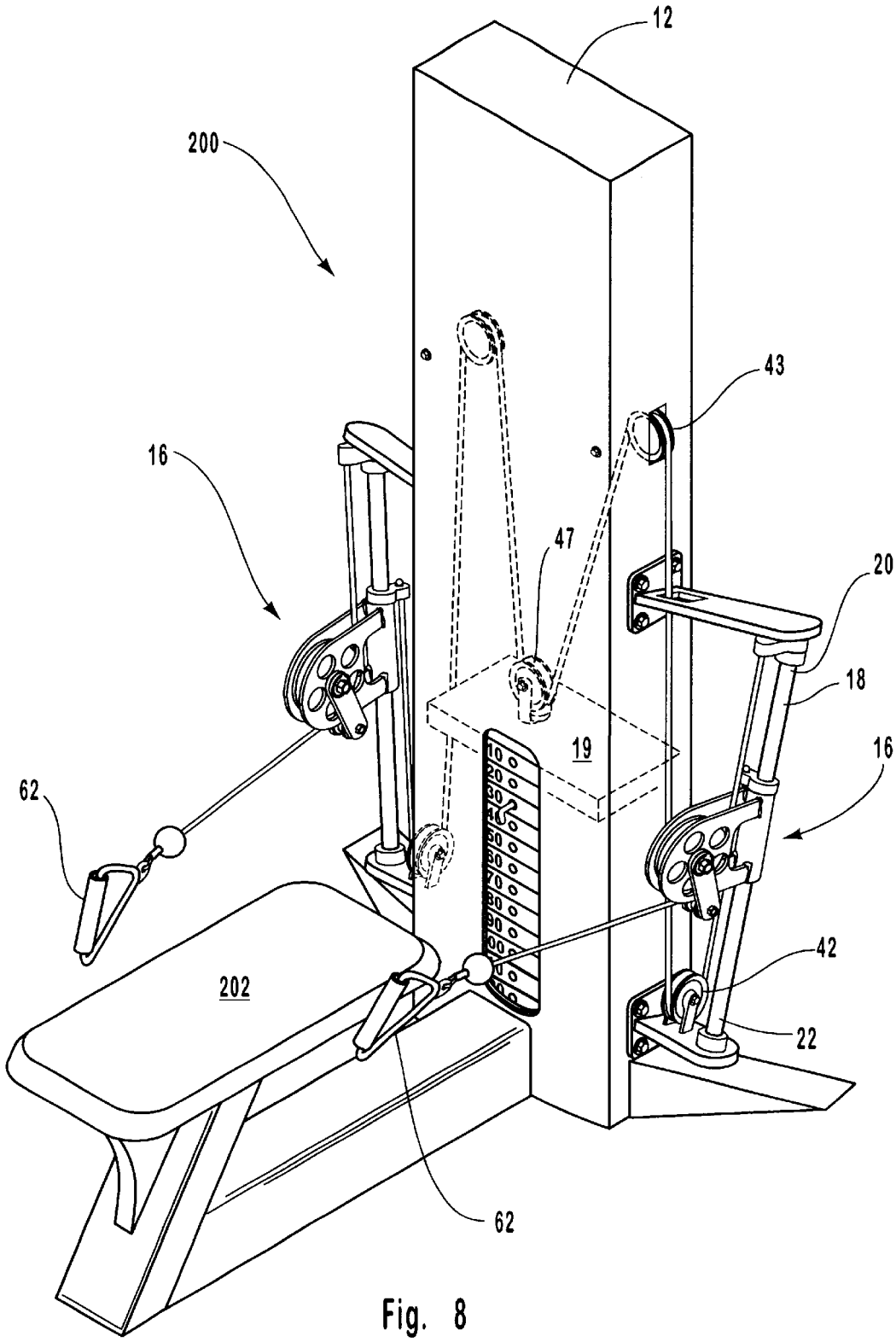
FIG. 8 illustrates a perspective view of another embodiment of the present invention.

In the embodiment shown in FIG. 8, exercise apparatus 200 comprises two identical pulley assemblies 16 mounted on each side of a frame 12. Pulley assemblies 16 are situated on the lower portion of frame 12. Exercise apparatus 200 has a seat 202 facing frame 12. Pulley assemblies 16 are disposed such that handles 62 may be grasped by the exerciser while sitting in seat 202. Note that FIG. 8 shows pulley assemblies 16 in actuated position 67. In this embodiment, pulley assemblies 16 are used for rowing exercises, arm curls, and the like. Thus, for those types of exercises, in resting position 64, sliding element 28 and pulley 30 are disposed at second end 22 of guide column 18. Similarly, pulley 42 is disposed near second end 22 of guide column 18 to provide an opposing force for sliding element 28. In this embodiment, other pulleys 43, 47 may be used to couple pulley 42 to weight stack 14. It will be appreciated that seat 202 is not required and that an exerciser may use exercise apparatus 200 while standing. An arm bench (not shown) may be disposed in front of seat 202 so that an exerciser may sit on seat 202 and perform arm curls on the arm bench.

Figure 9:
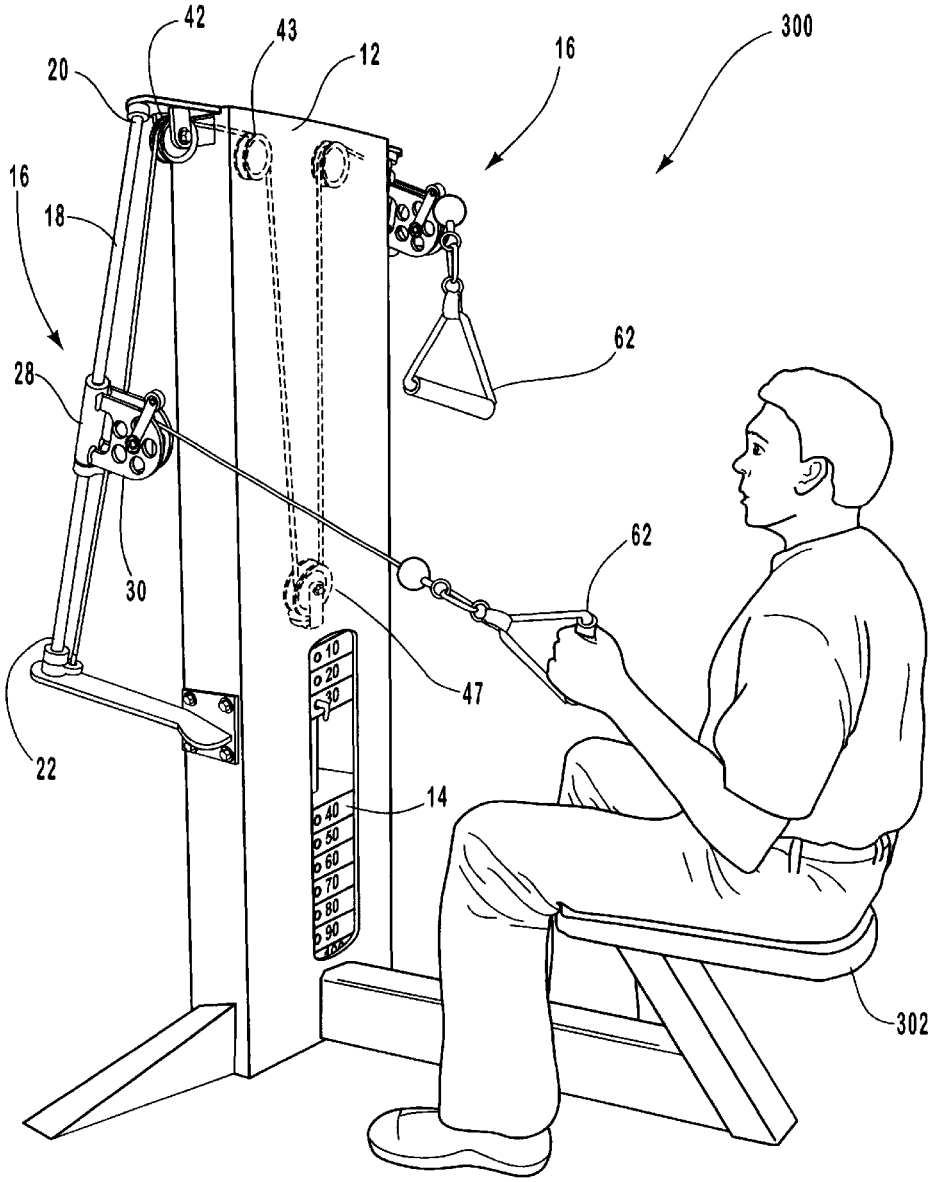
FIG. 9 illustrates a perspective view of yet another embodiment of the present invention.

In the embodiment shown in FIG. 9, exercise apparatus 300 comprises two identical pulley assemblies 16 mounted on each side of a frame 12. Pulley assemblies 16 are situated on an upper portion of frame 12. Exercise apparatus 300 has a seat 302 facing frame 12. Pulley assemblies 16 are disposed such that handles 62 may be grasped by the exerciser while sitting in seat 302. In this embodiment, pulley assemblies 16 are used for arm pulls, and other similar exercises. Thus, for those types of exercises, sliding element 28 and pulley 30 are disposed at first end 20 of guide column 18. Similarly, pulley 42 is disposed near first end 20 of guide column 18 to provide an opposing force for sliding element 28. In this embodiment, other pulleys 43, 47 may be used to couple pulley 42 to weight stack 14. It will be appreciated that seat 302 is not required and that an exerciser may use exercise apparatus 300 while standing. Seat 302 may further comprise leg supports (not shown) which prevent an exerciser's legs from raising as the exerciser is using exercise apparatus 300.

In another embodiment, two pairs of pulley assemblies 16 may be implemented in one exercise apparatus with one pair mounted on a top portion of frame 12 and another pair mounted on a bottom portion of frame 12. Seat 202 can be configured to provide support for the exerciser's legs when operating the top pulley assemblies 16, and an arm bench for supporting the exerciser's arms when operating the bottom pulley assemblies 16. In essence, this embodiment combines the embodiments shown in FIGS. 8 and 9.

Alternatively, two pulley assemblies 16 similar to those shown in FIG. 5 may be spaced apart and mounted to two wheel assemblies 104 on frame 12. Each sliding assembly 16 may be configured to rotate a complete 360° by slightly overlapping one on top of the other. Alternatively, each sliding assembly 16 may be configured to have a limited range of motion.

In addition, it is contemplated within the present invention that guide column 18 may have more than one sliding element 28 disposed thereon. For example, one guide column 18 may be disposed on wheel assembly 104 with a sliding element 28 placed at both ends of the guide column. Thus, the exerciser may position the guide column vertically so that one sliding element 28 is high and one is low. Alternatively, the exerciser may position the guide column horizontally so that sliding elements 28 are substantially horizontal. The exerciser may then use both sliding elements for arm-pulls or use sliding elements 28 individually for side-twist exercise and the like.

The present invention may be used to exercise various parts of the body. The above examples have been directed toward upper body exercises, particularly those performed by the arms. It will be appreciated that sliding assembly 16 of the present invention may be implemented in an exercise apparatus which is operated by the exerciser's legs or other part of the body. In this embodiment, second end 60 of cable 54 would be coupled to a device which translates motion from the leg to sliding assembly 16. For example, second end 60 could terminate into a loop which configures to fit an exerciser's foot. The exerciser then would be enabled to do leg swings or movements which would provide the exerciser with a smooth, low impact exercise while providing the exerciser with a continuous range of pull. Alternatively, second end 60 could be connected to a leg curl machine where the bending motion of the exerciser's legs results in selectively positioning sliding element 28 on guide column 18. In another embodiment, sliding assembly 16 may be configured on an exercise machine to work out both arms and legs. For example, one or more pulley assemblies 16 may be disposed-so that guide column 18 is positioned horizontally to construct a rowing machine. A seat may be slidably disposed on a frame. Thus, an exerciser is able to grasp handles 62 and perform rowing motions which are smooth and frictionless.

It is contemplated that the present invention may be useful in a variety of applications such as an exercise apparatus directed to sports-specific uses such as rowing, golf, and the like. The present invention will also be applicable in various rehabilitation and physical therapy applications. The present invention provides in all of these applications a smooth, low impact motion enhanced by the continuous range of pull.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A sliding assembly configured for use by an exerciser during an exercise routine, the sliding assembly comprising:

an elongate guide column having a first end and a second end;

a first mount rotatably coupled to the first end of the guide column;

a second mount rotatably coupled to the second end of the guide column;

a sliding element disposed on the guide column; and an actuation assembly coupled to the sliding element such that actuation of the actuation assembly selectively positions the sliding element along the guide column.

2. The sliding assembly as recited in claim 1, wherein the actuation assembly comprises a cable and pulley system, and wherein the cable and pulley system is coupled to a weight stack.

3. The sliding assembly as recited in claim 2, wherein the guide column is coupled to a frame, the frame housing the weight stack.

4. The sliding assembly as recited in claim 1, wherein the second mount and sliding element are independently rotatable in relation to each other.

5. The sliding assembly as recited in claim 4, wherein the second mount and guide column are independently rotatable in relation to each other.

6. The exercise apparatus as recited in claim 1, wherein the actuation assembly is coupled to the sliding element and is coupled to the first mount such that actuation of the actuation assembly selectively positions the sliding element along the guide column.

7. A sliding assembly configured for use by an exerciser during an exercise routine, the sliding assembly comprising:

an elongate guide column having a first end and a second end, a first mount rotatably coupled to at least one of the first and second ends of the guide column;

a sliding element disposed on the guide column; and an actuation assembly coupled to the sliding element such that actuation of the actuation assembly selectively positions the sliding element along the guide column, wherein the actuation assembly comprises a cable and pulley system, the cable and pulley system is coupled to a weight stack, and wherein the guide column is coupled to a frame, the frame housing the weight stack, wherein the guide column has a longitudinal axis of rotation, wherein the guide column is configured to selectively rotate about its longitudinal axis of rotation during an exercise routine.

8. The sliding assembly as recited in claim 7, wherein the guide column is rotatably coupled to a frame, the guide column and the first mount being independently rotatable in relation to each other.

9. The exercise apparatus as recited in claim 7, wherein the actuation assembly is coupled to the sliding element and is coupled to the first mount such that actuation of the actuation assembly selectively positions the sliding element along the guide column.

10. A sliding assembly configured for use by an exerciser during an exercise routine, the sliding assembly comprising:

an elongate guide column having a first end and a second end a sliding element disposed on the guide column;

a first mount rotatably coupled to at least one of the first and second ends of the guide column;

a second mount movably coupled to the guide column, wherein the second mount and sliding element are independently rotatable in relation to each other, and wherein the second mount is movably coupled to the guide column and the guide column is rotatably coupled to a frame, the frame housing a resistance assembly, wherein the second mount and the guide column are independently rotatable in relation to each other; and an actuation assembly coupled to the sliding element such that actuation of the actuation assembly selectively positions the sliding element along the guide column.

11. The exercise apparatus as recited in claim 10, wherein the actuation assembly is coupled to the sliding element and is coupled to the first mount such that actuation of the actuation assembly selectively positions the sliding element along the guide column.

12. A sliding assembly configured for use by an exerciser during an exercise routine, the sliding assembly comprising:

an elongate guide column having a first end and a second end;

a first mount rotatably coupled to at least one of the first and second ends of the guide column;

a sliding element disposed on the guide column, wherein the sliding element is rotatably coupled to the guide column; and an actuation assembly coupled to the sliding element such that actuation of the actuation assembly selectively positions the sliding element alone the guide column.

13. The exercise apparatus as recited in claim 12, wherein the actuation assembly is coupled to the sliding element and is coupled to the first mount such that actuation of the actuation assembly selectively positions the sliding element along the guide column.

14. A sliding assembly configured for use in conjunction with a weight stack, the weight stack being selectively moved by an exerciser during an exercise routine, the sliding assembly comprising:

an elongate guide column having a first end and a second end, the guide column having a longitudinal axis of rotation, wherein the guide column is configured to selectively rotate about its longitudinal axis of rotation during an exercise routine;

a sliding element disposed on the guide column such that the sliding element is selectively positionable between a resting position and an actuated position along the guide column; and an actuation assembly coupled to the sliding element.

15. An assembly as recited in claim 14, wherein the actuation assembly comprises a first pulley attached to the sliding element; and a first cable disposed on the first pulley.

16. The sliding assembly as recited in claim 15, further comprising:

a first mount rotatably coupled to one of the first and second ends of the guide column, wherein the first cable has a first end attached to the first mount, an intermediate portion disposed on the first pulley, and a second end terminating in a handle to be grasped by an exerciser.

17. The sliding assembly as recited in claim 16, wherein the guide column is coupled to a frame, the frame housing the weight stack.

18. The sliding assembly as recited in claim 17, wherein the first mount is rotatably coupled to the guide column and the guide column is rotatably coupled to a frame, the frame housing the weight stack, wherein the guide column and the first mount are independently rotatable in relation to each other.

19. The sliding assembly as recited in claim 16, further comprising a second mount movably coupled to the guide column, the second mount and the sliding element being independently rotatable in relation to each other.

20. The sliding assembly as recited in claim 16, further comprising a second mount movably coupled to the guide column, the second mount and guide column being independently rotatable in relation to each other.

21. The sliding assembly as recited in claim 20, wherein the guide column is coupled to a frame such that the guide column is rotatable about an axis transverse to the guide column, the frame housing the weight stack.

22. The sliding assembly as recited in claim 21, wherein the sliding element is rotatably coupled to the guide column.

23. The sliding assembly as recited in claim 20, further comprising:

a weight stack; and a cable having a first end coupled to the weight stack and a second end attached to the second mount.

24. The sliding assembly as recited in claim 14, the sliding element further comprising linear bearings so that the sliding element can freely slide along the guide column but is substantially prevented from rotating radially around the guide column, such that when a radial force is applied to the first pulley, the guide column and sliding element rotate substantially together around the longitudinal axis of rotation of the guide column.

25. An exercise apparatus for allowing an exerciser to target a variety of muscle groups, the exercise apparatus comprising:

a frame;

a resistance assembly;

a guide column coupled to the frame;

a sliding element disposed on the guide column and coupled to the resistance assembly, wherein the sliding element is selectively positionable between a resting position and an actuated position along the guide column;

a support member is disposed between the guide column and the frame, the guide column being coupled to the support member and the support member being coupled to the frame;

a wheel assembly is disposed between the support member and the frame, the support member being coupled to the wheel assembly and the wheel assembly being coupled to the frame such that the support member is rotatable about and axis transverse to the guide column;

a first cable having (i) an end that is movable by a user and (ii) a portion that contacts the sliding element, such that movement of the first cable moves the sliding element from the resting position to the actuated position; and a second cable having a first end and a second end, the first end being linked to the sliding element and the second end being linked to the resistance assembly.

26. The exercise apparatus as recited in claim 25, further comprising a first mount and a second mount movably coupled to the guide column.

27. An exercise apparatus as recited in claim 25, wherein the actuation assembly comprises a cable and pulley system.

28. An exercise apparatus for allowing an exerciser to target a variety of muscle groups, the exercise apparatus comprising:

a frame;

a resistance assembly;

a guide column coupled to the frame, the guide column being configured to selectively rotate about its axis of rotation during an exercise routine;

a sliding element disposed on the guide column and coupled to the resistance assembly, wherein the sliding element is selectively positionable between a resting position and an actuated position along the guide column; and an actuation assembly coupled to the sliding element such that actuation of the actuation assembly selectively positions the sliding element along the guide column.

29. The exercise apparatus as recited in claim 28, wherein the sliding element comprises linear bearings such that the sliding element can freely slide along the guide column but is substantially prevented from rotating radially around the guide column, such that when a radial force is applied to a first pulley, the guide column and sliding element rotate substantially together around the axis of rotation of the guide column.

30. The exercise apparatus as recited in claim 29, wherein the second mount and sliding element are rotatable independently of each other.

31. The exercise apparatus as recited in claim 30, wherein the second mount and the guide column are rotatable independently of each other.

32. An exercise apparatus for allowing an exerciser to target a variety of muscle groups, the exercise apparatus comprising:

a frame a resistance assembly;

a guide column coupled to the frame;

a sliding element disposed on the guide column and coupled to the resistance assembly, wherein the sliding element is selectively positionable between a resting position and an actuated position along the guide column; and an actuation assembly coupled to the sliding element such that actuation of the actuation assembly selectively positions the sliding element along the guide column wherein the actuation assembly comprises a cable and pulley system; and a first mount rotatably coupled to one of the first and second ends of the guide column, wherein the cable and pulley system comprises a first pulley attached to the sliding element and a first cable, wherein the first cable has a first end attached to the first mount, an intermediate portion disposed on the first pulley, and a second end terminating in a handle to be grasped by an exerciser.

33. The exercise apparatus as recited in claim 32, wherein the resistance assembly comprises a weight stack coupled to the frame, wherein the weight stack is comprised of a plurality of weights such that an exerciser is able to select at least one weight from the weight stack.

34. The exercise apparatus as recited in claim 33, wherein the resistance assembly further comprises:

a second cable and pulley system coupled to the weight stack and to the sliding element.

35. An exercise apparatus for providing a continuous range of pull so as to target a variety of muscle groups, the exercise apparatus comprising:

a frame;

a resistance assembly coupled to the frame, the resistance assembly comprising a plurality of weights such that an exerciser is able to select an amount of resistance; and a sliding assembly coupled to the frame, the sliding assembly comprising:

an elongate guide column having a first end and a second end, a first mount rotatably coupled to at least one of the first and second ends of the guide column, a sliding element disposed on the guide column and coupled to the resistance assembly, and a cable and pulley system coupled to the sliding element and coupled to the first mount such that actuation of the cable and pulley system selectively positions the sliding element between a resting position and an actuated position along the guide column, wherein the cable and pulley system comprises:

a first pulley attached to the sliding element; and a first cable disposed on the first pulley, the first cable having a first end attached to the first mount, an intermediate portion disposed on the first pulley, and a second end terminating in a handle to be grasped by an exerciser.

36. The exercise apparatus as recited in claim 35, further comprising a second mount movably coupled to the guide column.

37. The exercise apparatus as recited in claim 33, wherein the resistance assembly comprises a second cable and pulley system, the second cable and pulley system comprising:

a second pulley attached to the frame; and a second cable disposed on the second pulley, the second cable having a first end attached to the second mount, an intermediate portion disposed on the second pulley, and a second end coupled to the plurality of weights.

38. The exercise apparatus as recited in claim 35, further comprising a second sliding assembly coupled to the frame, the second sliding assembly comprising:

an elongate guide column having a first end and a second end;

a first mount rotatably coupled to at least one of the first and second ends of the guide column;

a sliding element disposed on the guide column and coupled to the resistance assembly; and a cable and pulley system coupled to the sliding element and coupled to the first mount such that actuation of the cable and pulley system selectively positions the sliding element between a resting position and an actuated position along the guide column.

39. An exercise apparatus for providing a continuous range of pull so as to target a variety of muscle groups, the exercise apparatus comprising:

a frame;

a resistance assembly coupled to the frame, the resistance assembly comprising a plurality of weights such that an exerciser is able to select an amount of resistance; and a sliding assembly coupled to the frame, the sliding assembly comprising:

an elongate guide column having a first end and a second end, wherein the guide column has a longitudinal axis of rotation, wherein the guide column is configured to selectively rotate about its longitudinal axis of rotation during an exercise routine, a first mount rotatably coupled to at least one of the first and second ends of the guide column, a sliding element disposed on the guide column and coupled to the resistance assembly, and a cable and pulley system coupled to the sliding element and coupled to the first mount such that actuation of the cable and pulley system selectively positions the sliding element between a resting position and an actuated position along the guide column.

40. An exercise apparatus for providing a continuous range of pull so as to target a variety of muscle groups, the exercise apparatus comprising:

a frame;

a resistance assembly coupled to the frame, the resistance assembly comprising a plurality of weights such that an exerciser is able to select an amount of resistance; and a sliding assembly coupled to the frame, the sliding assembly comprising:

an elongate guide column haying a first end and a second end, a first mount rotatably coupled to at least one of the first and second ends of the guide column, a sliding element disposed on the guide column and coupled to the resistance assembly, and a cable and pulley system coupled to the sliding element and coupled to the first mount such that actuation of the cable and pulley system selectively positions the sliding element between a resting position and an actuated position along the guide column.

41. An exercise apparatus for providing a continuous range of pull so as to target a variety of muscle groups, the exercise apparatus comprising:

a frame;

a resistance assembly coupled to the frame, the resistance assembly comprising a plurality of weights such that an exerciser is able to select an amount of resistance; and a sliding assembly coupled to the frame, the sliding assembly comprising:

an elongate guide column having a first end and a second end, a first mount rotatably coupled to at least one of the first and second ends of the guide column, a sliding element disposed on the guide column and coupled to the resistance assembly, a support member being disposed between the sliding assembly and the frame, the sliding assembly being coupled to the support member and the support member being coupled to the frame, and a cable and pulley system coupled to the sliding element and coupled to the first mount such that actuation of the cable and pulley system selectively positions the sliding element between a resting position and an actuated position along the guide column.

42. The exercise apparatus as recited in claim 41, wherein the wheel assembly is positionable about every 10° to 15°.

* * * * *

UNITED STATES PATENT AND TRADEMARK OFFICE

CERTIFICATE OF CORRECTION

PATENT NO. : 6,770,015 B2
APPLICATION NO. : 10/205787
DATED : August 3, 2004
INVENTOR(S) : Simonson It is certified that error appears in the above-identified patent and that said Letters Patent is hereby corrected as shown below:

Column 2
Line 10, before “following” insert --the--

Column 3
Line 3, change “firsthand” to --first and--
Line 5, before “is mounted” insert --18--

Column 4
Line 3, after “43” remove “is”
Line 20, before “chain” insert --a--
Line 62, before “increases” change “a” to --α--

Column 6
Line 24, after “mount 36” insert --may--
Line 63, before “guide” change “receiving” to --receive--

Column 7
Line 9, after “column” insert --18--
Line 15, before “guide” change “receiving” to --receive--

Column 9
Line 27, after “spring” remove “125”
Line 30, after “132 may” remove “be”

Column 11
Line 29, change “disposed-so” to --disposed so--

Column 12
Line 46, after “end” begin a new sub-paragraph.
Line 46, change “end” to --end;--

Column 13
Line 33, after “element” remove “;”

Column 14
Line 30, before “axis” change “and” to --an--

UNITED STATES PATENT AND TRADEMARK OFFICE

CERTIFICATE OF CORRECTION

PATENT NO. : 6,770,015 B2
APPLICATION NO. : 10/205787
DATED : August 3, 2004
INVENTOR(S) : Simonson It is certified that error appears in the above-identified patent and that said Letters Patent is hereby corrected as shown below:

Column 16
Line 60, after "column" change "haying" to --having--
Line 65, after "assembly," remove "and"
Between lines 65 and 66, insert the following sub-paragraph:

--a support member being disposed between the sliding assembly and the frame, the sliding assembly being coupled to the support member and the support member being coupled to the frame, and--

Column 18
Line 6, after "frame," remove "and"
Between lines 5 and 6, insert the following sub-paragraph:

--a wheel assembly being disposed between the support member and the frame, the support member being coupled to the wheel assembly and the wheel assembly being coupled to the frame such that the sliding assembly is rotatable about an axis transverse to the sliding assembly, and--

Signed and Sealed this

Twenty-second Day of May, 2007

JON W. DUDAS
*Director of the United States Patent and Trademark Office*